US005201270A

United States Patent [19]

Dörsam et al.

[11] Patent Number: 5,201,270

[45] Date of Patent: Apr. 13, 1993

[54] DISTRIBUTOR ROLLER FOR PRINTING PRESS

[75] Inventors: Willi R. L. Dörsam, Höchberg; Jürgen A. Stiel, Ostheim, both of Fed. Rep. of Germany

[73] Assignee: Koenig & Bauer Aktiengesellschaft, Wurzburg, Fed. Rep. of Germany

[21] Appl. No.: 866,505

[22] Filed: Apr. 10, 1992

[30] Foreign Application Priority Data

Apr. 25, 1991 [DE] Fed. Rep. of Germany ..... 4113491

[51] Int. Cl.[5] ..... B41F 31/14; B41D 27/16

[52] U.S. Cl. ..... 101/348; 101/DIG. 38

[58] Field of Search ..... 101/348, 349, DIG. 38, 101/350, 148, 207, 208-210; 118/244, 256, 258; 29/110

[56] References Cited

U.S. PATENT DOCUMENTS 4,170,176 10/1979 Domeniconi ..... 101/DIG. 38

FOREIGN PATENT DOCUMENTS 0047861 8/1981 European Pat. Off. .
139802 3/1902 Fed. Rep. of Germany .
207482 4/1908 Fed. Rep. of Germany .
1163855 11/1954 Fed. Rep. of Germany .
2935014 8/1979 Fed. Rep. of Germany .

*Primary Examiner*—J. Reed Fisher
*Attorney, Agent, or Firm*—Jones, Tullar & Cooper

[57] ABSTRACT

A distributor roller for a printing press is usable to distribute fluids or inks by rotational and axial movement. The roller is driven by frictional engagement with a cooperating roller. Axial oscillatory movement of the roller with respect to its roller shaft is accomplished by preventing a drive housing from rotating with the roller body. The distributor roller may be used as an oscillating or non-oscillating ink transport roller.

23 Claims, 4 Drawing Sheets

DISTRIBUTOR ROLLER FOR PRINTING PRESS

FIELD OF THE INVENTION

The present invention is directed generally to a distributor roller for a printing press. More particularly, the present invention is directed to a frictionally driven distributor roller for a printing press. Most specifically, the present invention is directed to a frictionally driven distributor roller that can selectively also be axially oscillated with respect to the roller with which it is in frictional drive contact. The distributor roller is rotatably supported on a rotatable shaft which also carries a selectively rotatable drive housing. If the drive housing is held stationary, the rotatable shaft will be driven by a gear assembly in the drive housing at a rotational speed which is different from the rotational speed of the distributor roller. A cam and cam follower assembly causes the distributor roller to oscillate on the shaft. If the drive housing is engaged with the distributor roller, there is no oscillation of the distributor roller.

DESCRIPTION OF THE PRIOR ART

Ink distributor rollers are generally well known in the printing press art. These distributor rollers are virtually always used in printing presses if the printing image requires an irregular ink distribution across the surface. These distributor rollers also have a beneficial ink splitting effect as well as their intended ink distribution effect.

In the German unexamined published patent application No. 29 35 014 there is disclosed a distributor roller for a printing press. In this assembly, the distributor roller is driven through a frictional contact through the outer surface of the roller body. This prior art distributor roller can be thrown onto, or brought into contact with different inking or dampening fluid rollers in an alternative manner. These various rollers are supported between the side frames of the printing press assembly. The distributor roller is caused to move axially with respect to the inking or dampening fluid roller with which it is in frictional drive contact. This is accomplished in this prior art device through the use of a two step spur gear between the outer surface or envelope of the distributor roller and its shaft. A cam follower circulates in a cam drive at a differential speed to the cam and this results in an axial movement of the distributor roller.

This prior art distributor roller assembly must be disassembled and taken out of the roller frame when it is not needed. It is not desirable to continue to utilize an axially oscillating distributor roller when its function is not required. The axial oscillation of the distributor roller will cause unnecessary wearing of the printing plates. There is also an unintended development of heat that is caused by the drive assembly. This heat will increase the surface temperature of the rollers and these rollers should be kept at as constant a temperature as possible for printing reasons.

In the European patent specification No. 00 47 861, there is shown an inking unit which has oscillating ink forme rollers. In this assembly, the oscillating stroke of the rollers can be switched off. The oscillating motion is accomplished by using a toothed gear which is fixed on a first shaft and which is in engagement with a tooth gear that is fixed on an adjacent shaft. The limitation of this prior art assembly is that the oscillating ink forme roller must be in tooth gear engagement with an adjacent shaft. This limits the situations in which this assembly can be used. Thus this prior art oscillating ink forme roller assembly is not universally applicable.

It will thus be apparent that a need exists for an oscillating distributor roller that is easily and expeditiously capable of being switched off or on and that is universally applicable. The distributor roller for a printing press in accordance with the present invention provides such a device and is a significant improvement over the prior art devices.

SUMMARY OF THE INVENTION

It is an object of the present invention to provide a distributor roller for a printing press.

Another object of the present invention is to provide an oscillating distributor roller for a printing press.

A further object of the present invention is to provide an oscillating distributor roller having a frictional drive for the roller envelope or outer surface.

Still another object of the present invention is to provide an oscillating distributor roller in which the oscillating stroke can be stopped.

Yet a further object of the present invention is to provide an oscillating distributor roller that is usable as an ink transport roller when the oscillating stroke is shut off.

Even still another object of the present invention is to provide an oscillating distributor roller that does not require any external drive assembly and that is thus universally applicable.

As will be discussed in detail in the description of the preferred embodiment which is set forth subsequently, the distributor roller for a printing press in accordance with the present invention is driven through frictional contact of the outer surface of the roller body with the roller in which it is in engagement. A first gear is attached to the distributor roller body and both are rotatable and axially slidable on a rotatable shaft. A gear housing is also supported on the shaft. This gear housing may be connected to a side frame of the printing press. When in this mode, the rotatable shaft is driven at a speed of rotation which is different from the speed of rotation of the distributor roller body. The roller body carries two cams and the rotatable shaft carries two cam followers. The difference in rotational speed between the two results in an oscillatory motion of the distributor roller. When the gear housing is disconnected from the side frame, it is connected to the body of the distributor roller. This results in both the distributor roller body and the rotatable support shaft running at the same speed. Since there is now no relative rotational motion between the cams and cam followers, the distributor roller does not oscillate on the rotatable shaft.

The distributor roller in accordance with the present invention does not require that the distributor roller be disassembled or taken apart when it is to be used solely as an ink or fluid transfer roller. The gear housing is disconnected from the side frame by movement of a sliding bolt. Now the distributor roller no longer oscillates. This results in less printing plate and roller wear. The distributor roller is also suitable for universal application and does not require an additional tooth gear assembly with which to mesh.

The gear housing and its associated meshing gears are located outside of the body of the distributor roller. This results in less heat build-up since the heat generated by the gear train is more easily dissipated. This results in lower roller surface temperatures and higher printing quality.

The drive housing is engageable with and disengageable from the side frame by a shiftable indexing bolt. Thus the oscillating stroke of the assembly is switched on or off in a technically uncomplicated manner. The indexing bolt can be located either in the side frame or in the gear drive housing. Alternatively, the coupling could be accomplished by using a friction clutch or the like that would be attached to the side frame of the press. This would allow the oscillating stroke of the distributor roller to be switched on or off by remote control.

Other devices are usable to stop the oscillating stroke of the distributor roller by interrupting the force flux between the gear drive housing joined to the side frame and the distributor roller. For example, a multiple wedge sleeve or muff coupling on an idler shaft or on a shaft between the distributor roller and the drive housing could be used to separate the shafts. The same effect could be accomplished by mounting one of the tooth gears of the double pinion positioned between the gear assemblies on the idler shaft by means of an indexing bolt or pin that could be used to connect or disconnect the pinion to the shaft.

The distributor roller for a printing press in accordance with the present invention overcomes the limitations of the prior devices and is a substantial advance in the art.

BRIEF DESCRIPTION OF THE DRAWINGS

While the novel features of the distributor roller for a printing press in accordance with the present invention are set forth with particularity in the appended claims, a full and complete understanding of the invention may be had by referring to the detailed description of the preferred embodiment, as set forth subsequently, and as illustrated in the accompanying drawings, in which:

DESCRIPTION OF THE PREFERRED EMBODIMENT

Figure 1:
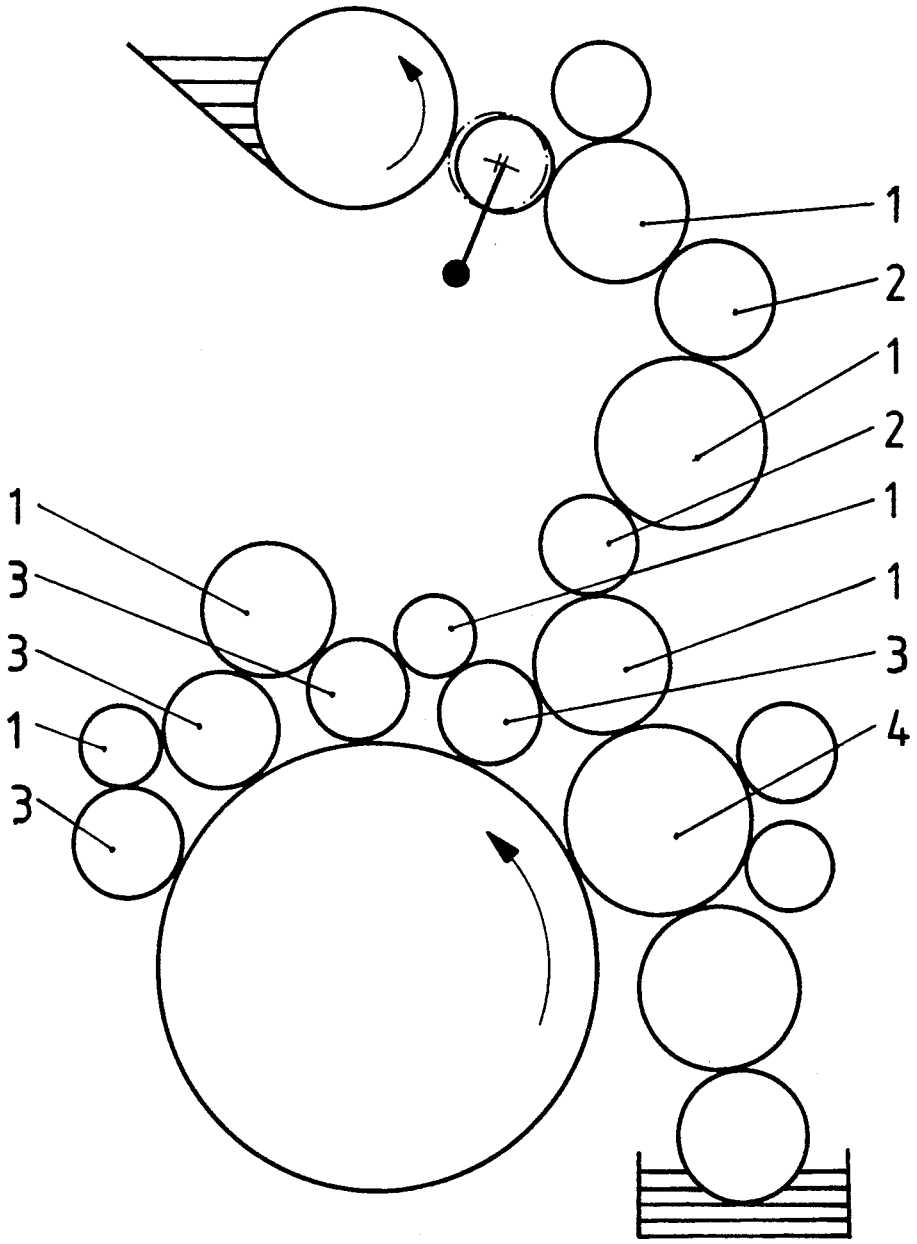
FIG. 1 is a schematic side elevation view of an inking and dampening unit of a printing press in which the distributor roller of the present invention finds application.

Referring initially to FIG. 1, there may be seen a schematic depiction of an inking and dampening unit for a printing press in which the distributor roller in accordance with the present invention may be used. A plurality of distributor rollers, each indicated generally at 1, may be used in the inking and dampening unit shown in FIG. 1 and may be brought into contact with any of the several ink transport rollers 2, forme rollers 3 or the dampening forme roller 4, all of which are shown in the roller system depicted in FIG. 1. While the invention will be discussed hereinafter as being used with a distributor roller, it will be understood that the ink transport roller 2, the forme roller 3 or the dampening forme roller 4 could also be equipped with the same features as will now be discussed for use with the distributor roller 1.

Figure 2:
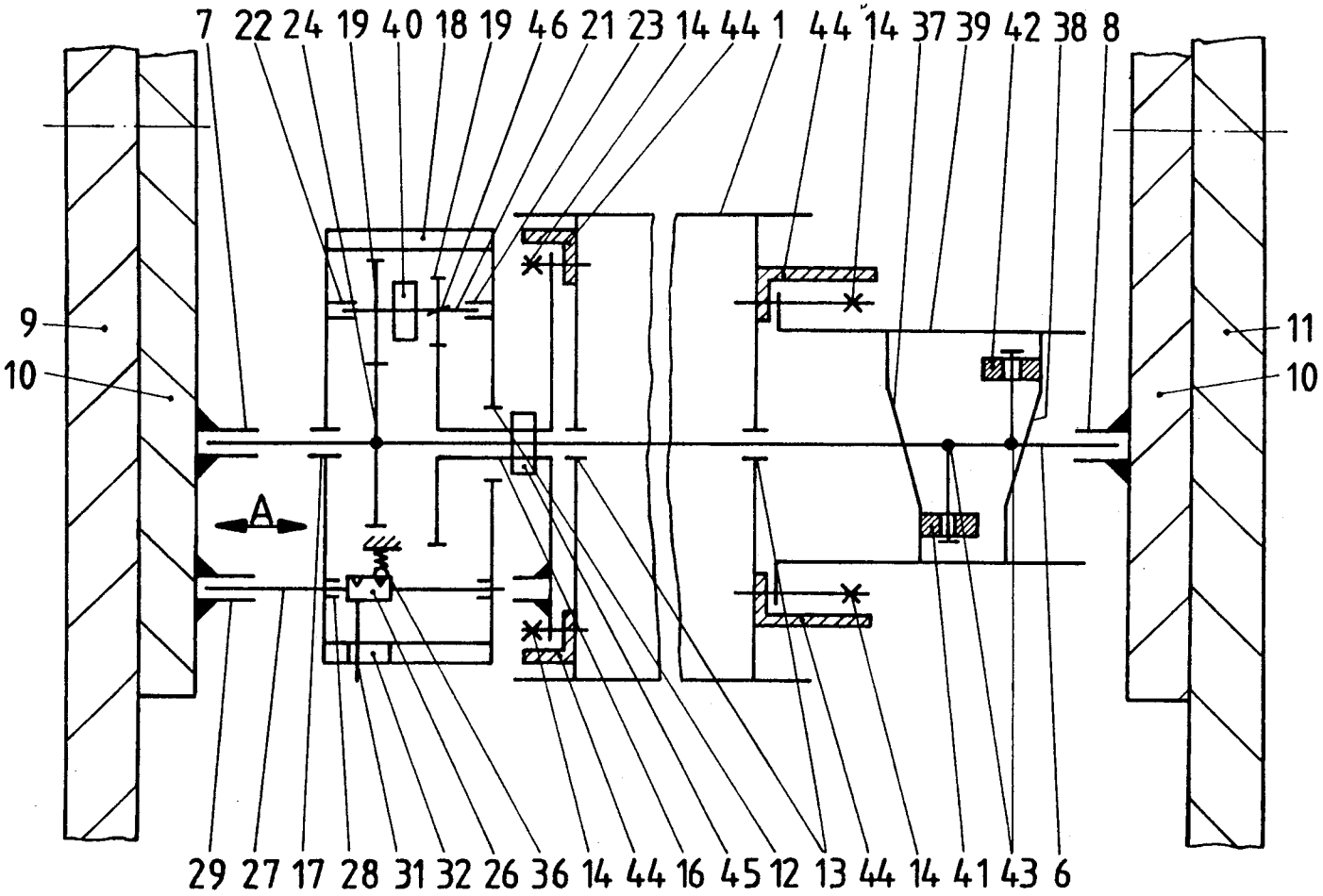
FIG. 2 is a schematic cross-sectional side view of a distributor roller in accordance with the present invention.

Turning now primarily to FIG. 2, there is seen a schematic depiction of a distributor roller 1 in accordance with the present invention. The distributor roller 1 has a roller body which is rotatably supported on a rotatable roller shaft 6. This rotatable shaft 6 is supported at its ends by ball bearing assemblies 7 and 8. Ball bearing assembly 7 is a fixed bearing assembly while ball bearing assembly 8 is a thrust or load bearing assembly. Both of these ball bearing assemblies are secured in roller sockets that are adjustably carried by bearing arms 10 in spaced side frames 9 and 11 of the printing press.

The roller body of the distributor roller i is rotatably and oscillatably supported on roller shaft 6 by needle bearings 13. A roller gear 16 is secured to a first end or side face of the roller body of distributor roller 1 and is positioned centrally about roller shaft 6. Suitable screws or other fasteners 14 are used to attach roller gear 16 to the roller body. Thus roller gear 16 rotates with the roller body of distributor roller 1.

A rotatable drive housing 18 is rotatably supported on roller shaft 6. This is accomplished by suitable needle bearings 12 which ride on the portion of roller gear 16 that surrounds shaft 6 and by ball bearings 17 that engage shaft 6. Thus drive housing 18 is rotatable with respect to roller body 1 and roller shaft 6. A double pinion assembly 19 is carried in drive housing 18 and is secured to an idler shaft 21 that is rotatably supported in bearings 22 and 23 which are attached to the drive housing 18. A first gear of the double pinion 19 meshes with the roller gear 16. The second gear of the double pinion 19 meshes with a shaft gear 24 that is securely affixed to roller shaft 6. The roller gear 16 and the shaft gear 24 have different numbers of teeth. Thus they rotate at different speeds. It would be possible to provide these two gears with the same numbers of teeth and to provide different numbers of teeth on the first and second gears of the double pinion 19.

The drive housing 18 may either be secured to the side of the bearing arm 10 or to the side frame 9 by a suitable coupling as will be discussed shortly, or may be allowed to rotate with the roller body of the distributor roller 1. When the drive housing 18 is fixed, the distributor roller 1 will oscillate axially with respect to roller shaft 6, as will also be discussed shortly. When the drive housing 18 rotates with the distributor roller body 1, there is no oscillatory motion.

Figure 3:
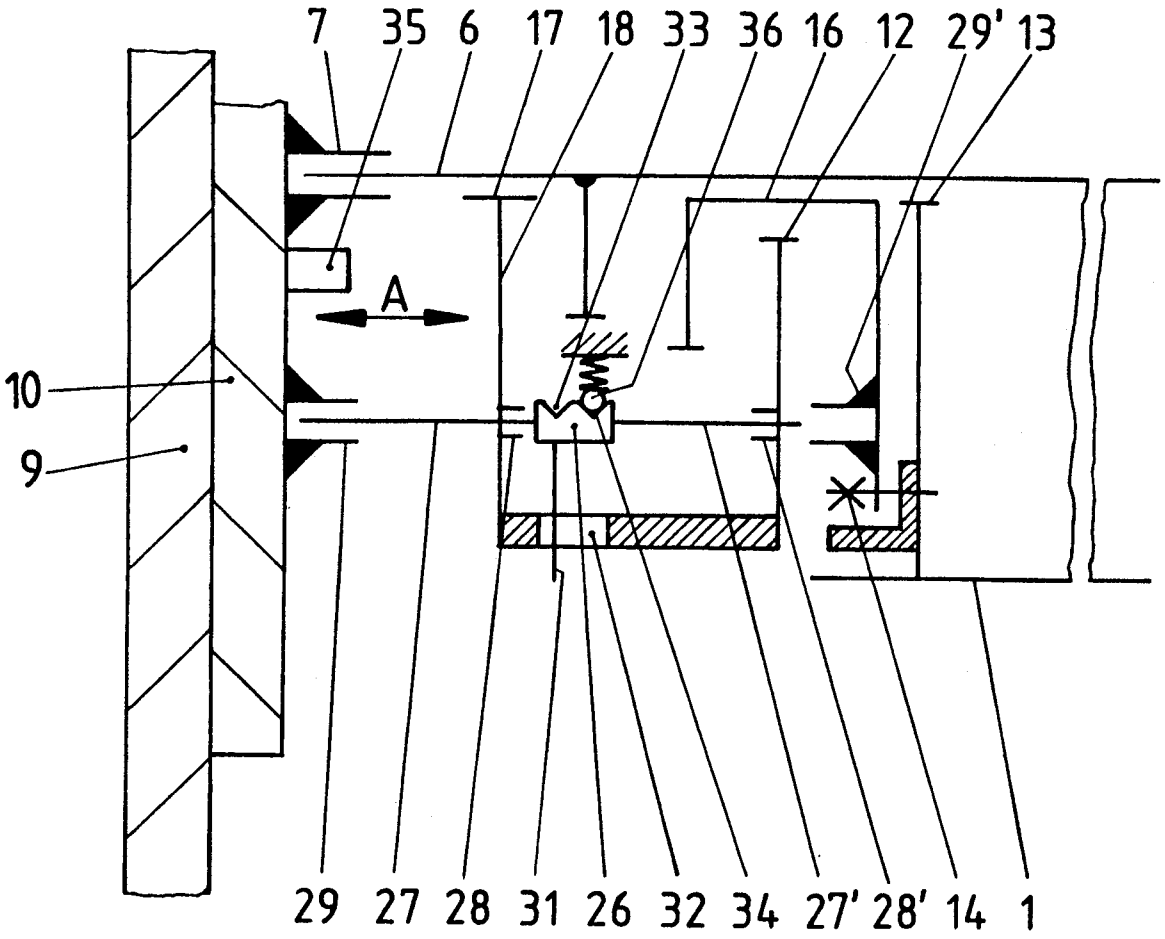
FIG. 3 is a schematic depiction of a portion of the distributor roller and showing the roller in an oscillating mode.
Figure 4:
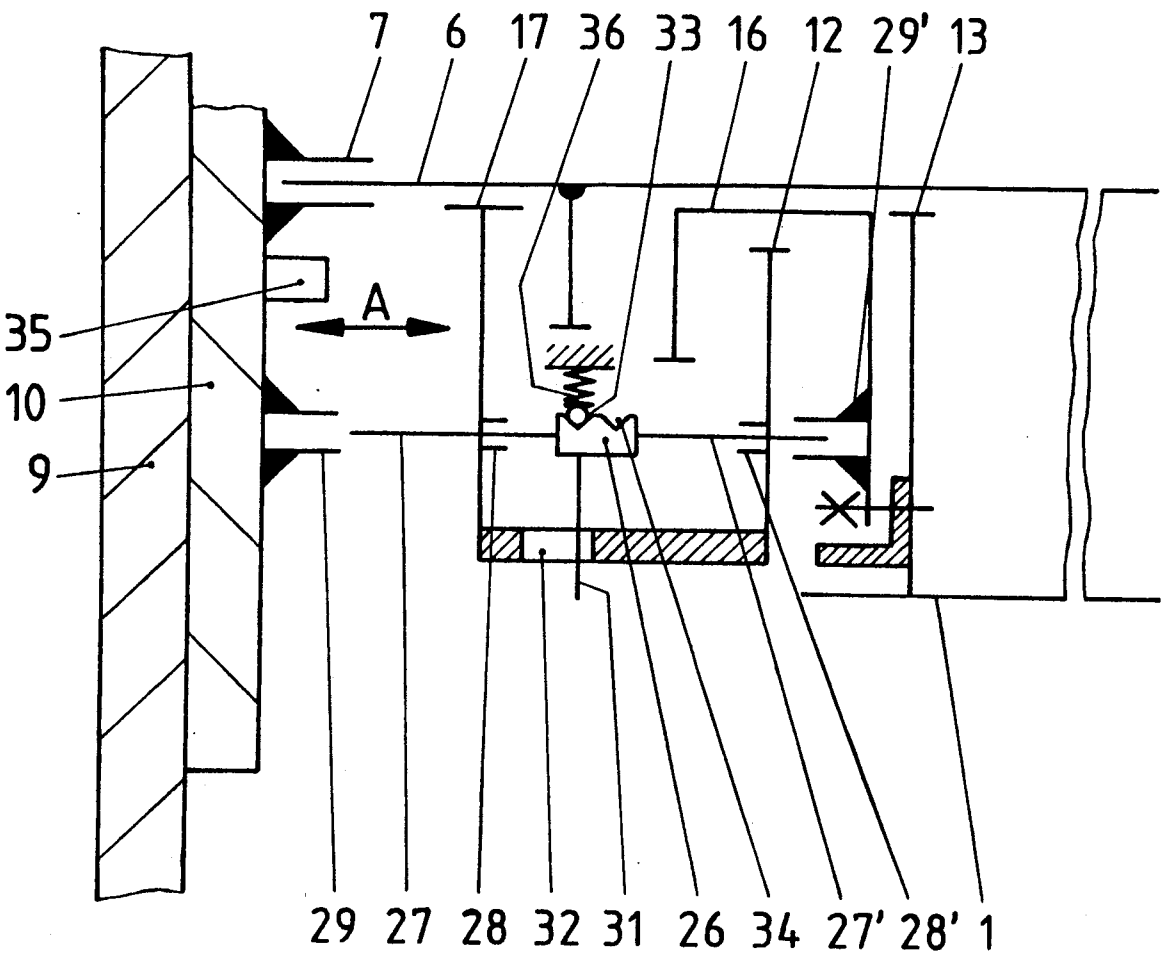
FIG. 4 is a view similar to FIG. 3 and showing the distributor roller in a non-oscillating mode.

Referring now to FIGS. 3 and 4 the drive housing 18 may be secured to the bearing arm 10 by an indexing bolt 27 that is provided with a sliding block 26. The indexing bolt 27 is slidable in the directions indicated by arrow A in FIGS. 3 and 4. When indexing bolt 27 is in the position shown in FIG. 3, it has a first end that is received in a thrust bearing 29 that is attached to the bearing arm 10 or the side frame 9. This prevents drive housing 18 from rotating with the distributor roller 1. Sliding block 26 is provided with an operating lever 31, such as a handle, that extends through an elongated slot 32 in the drive housing 18. This lever 31 is slidable in the directions indicated by arrow A. The sliding block 26 is provided with spaced recesses 33 and 34. A spring biased ball catch 36 is receivable in either one of these recesses. When the indexing bolt 27 is in the locked position depicted in FIG. 3, the ball 36 is in recess 34. As seen in FIG. 4, when the bolt 27 is in the released position, the ball 36 is in recess 33.

Instead of using a sliding indexing bolt 27, the drive housing 18 could be secured against the side frame 9 by use of a suitable friction clutch which is schematically depicted at 35 in FIG. 3. This friction clutch could be operated by suitable mechanical, magnetic, pneumatic, hydraulic, or electrical means and could engage the side of the gear housing 18 to hold it against rotation.

Turning now to FIG. 4, the indexing bolt 27 has a second end 27' which is slidably supported in a sliding block 28'. This sliding block 28' may be a guide sleeve or the like that is formed in a wall of the drive housing 18. This second end 27' of the indexing bolt 27 is received in a thrust bearing 29' that is carried on the roller gear 16. Thus when the indexing bolt 27 is positioned in the unlocked position depicted in FIG. 4, the drive housing 18 is rotatable with the distributor roller body 1.

Returning to FIG. 2, a pair of oscillating cams 37 and 38 are secured to an elongated, cylindrical sleeve 39 which is secured by screws 14 to the second end or side face of the distributor roller body 1 on the end opposite the roller gear 16. Suitable fixing pins (not shown) are used to secure the oscillating cams 37 and 38 to the sleeve 39. This means that the oscillating cams 37 and 38 rotate with the roller body 1. A pair of cam followers 41 and 42 are secured to roller shaft 6 by suitable clamping screws 43. Each cam follower 41 or 42 rides on its cooperating cam 37 or 38. A generally cylindrical heat insulation shield 44 is also secured to the second end of the distribution roller body This heat insulation 44, which may be made of a suitable plastic is concentric with the roller shaft 6.

The operation of the distributor roller in accordance with the present invention will now be discussed. The body of the distributor roller 1 will be in frictional drive engagement with one of the associated rollers 2, 3, or 4, as shown in FIG. 1. With the indexing bolt 27 slid into the thrust bearing 29, as seen in FIG. 3, the drive housing 18 is prevented from rotating. Thus the roller gear 16, which is rotating with the roller body 1, will engage the first pinion of the double pinion 19 and will cause it to rotate with the idler shaft 21. The second pinion of the double pinion 19 drives the shaft gear 24 which is affixed to the roller shaft 6. Since the roller gear 16 and the shaft gear 24 are of different sizes, the roller shaft 6 will rotate at a speed, n2 which is different from the speed of rotation, n1 of the distributor roller body This difference thus causes the oscillating cams 37 and 38 to rotate with respect to the cam followers 41 and 42. The result is an oscillating movement of the distributor roller along the roller shaft 6 on the needle bearings 13.

If the handle 31 is moved to the position shown in FIG. 4, in which the indexing bolt 27 is disengaged from the thrust bearing 29 and further in which the second end 27' is received in the thrust bearing 29', the drive housing 18 is now fixed to the roller gear 16 and accordingly rotates at the same speed as the distributor roller body 1. This means that the distributor roller 1, drive housing 18 and the roller shaft 6 all rotate at the same speed in the bearing assemblies 7 and 8. Since there is now no relative rotation between the oscillating cams 37 and 38 and the cam followers 41 and 42, the distributor roller body 1 does not oscillate axially along the roller shaft 6.

The positioning of the second end 27' of the indexing bolt 27 in the thrust bearing 29' on the roller gear 16 to connect the drive housing 18 to the roller gear 16 is done primarily as a safety lock. When the indexing bolt 27 is moved out of the bearing 29 on the fixed side frame 9 or the bearing arm 10, the frictional resistance of the spur gear and the cam gear will not allow a relative rotation between the drive housing 18 and the roller 1. The relative rotation between the two, and thus the oscillating stroke of the distributor roller 1 can only be accomplished if the drive housing 18 is securely locked to the side frame 9, as depicted in FIG. 3.

Other mechanisms could be utilized to interrupt the connection of the drive housing 18 with the roller gear 16 or the side frames. For example, a multiple wedge sleeve or muff coupling 40 could be secured to the idler shaft 21 between the two pinion gears of the double pinion 19. Alternatively, a multiple wedge sleeve or muff coupling 45 could be placed on the roller shaft 6. The same effect would be realized if one of the pinion gears of the double pinion 19 were secured to the idler shaft 21 by an index pin 46. This pin 46 could by generally cylindrical in shape and could be received in a standard drilled bushing. A handle (not shown) could be joined to pin 46 and could extend beyond the drive housing 18. Removal of this pin 46 would thus effectively disconnect the drive housing from the roller gear 16. It will be understood that a variety of switchable positive or non-positive couplings may be used to couple the distributor roller body 1 to the drive housing 18.

While a preferred embodiment of a distributor roller for a printing press in accordance with the present invention has been set forth fully and completely hereinabove, it will be apparent to one of skill in the art that a number of changes in, for example the type of printing press, the size of the roller, the types of fastening devices and the like can be made without departing from the true spirit and scope of the subject invention which is accordingly to be limited only by the following claims.

What is claimed is:

1. A distributor roller usable in a printing pres for distributing fluids and ink by means of rotating and selective axial oscillatory movement; said distributor roller comprising:

a distributor roller body, said roller body being rotatably driven at a first speed by frictional contact with a cooperating roller;

a roller shaft rotatably supported in side frames of the printing press and rotatably driven by said rotating distributor roller body;

means for effecting selective axial oscillatory motion of said distributor roller body with respect to said roller shaft; and coupling means for coupling said distributor roller body to said roller shaft to selectively cause said distributor roller body to rotatably drive said roller shaft at said first speed or at a second different speed, where at said first speed said distributor roller body and said roller shaft rotate at the same speed without axial oscillating motion between said distributor roller body and said roller shaft, and where at said second speed there is relative rotation and axial oscillatory motion between said distributor roller body and said roller shaft.

2. The distributor roller of claim 1 wherein said means for effecting axial oscillatory motion includes a drive housing and further wherein said coupling means is usable to couple said drive housing to the side frame of the press.

3. The distributor roller of claim 2 wherein a roller gear is carried by said distributor roller, wherein a shaft gear is secured to said roller shaft, and further wherein an idler shaft is rotatably supported in said drive housing and carries a double pinion having first and second different sized pinion gears, said first pinion gear of said double pinion engaging said roller gear and said second pinion gear of said double pinion engaging said shaft gear wherein said coupling of said drive housing to the side frame of the press causes said shaft gear and said roller gear to be rotated at different speeds by said first and second different sized pinion gears to effect said axial oscillating motion.

4. The distributor roller of claim 3 wherein said coupling means includes an indexing bolt slidably supported in said drive housing for selective axial movement in a first direction against a thrust bearing secured on the side frame.

5. The distributor roller of claim 4 wherein said indexing bolt carries a sliding block, said sliding block having spaced recesses which selectively receive a ball catch to hold said indexing bolt in a selected position.

6. The distributor roller of claim 5 wherein said sliding block has an actuating handle, said actuating handle extending through a slot in said drive housing.

7. The distributor roller of claim 2 wherein said coupling means is a friction coupling between said drive housing and the side frame of the press.

8. The distributor roller of claim 4 wherein said indexing bolt is slidable in a second direction into engagement with a thrust bearing carried on said roller gear.

9. The distributor roller of claim 3 wherein said coupling means includes means for rotatably supporting at least one of said pinion gears on said idler shaft and further includes a means for preventing rotation between said rotatably supported pinion gear and said idler shaft.

10. The distributor roller of claim 3 wherein said coupling means includes a multiple wedge sleeve coupling on said idler shaft.

11. The distributor roller of claim 3 wherein said coupling means includes a multiple wedge sleeve coupling on said roller shaft between said distributor roller body and said drive housing.

12. The distributor roller of claim 1 wherein said means for effecting axial oscillatory motion of said distributor roller body includes first and second oscillatory cams secured to said distributor roller body and first and second cam followers secured on said roller shaft.

13. The distributor roller of claim 2 wherein said drive housing is carried on said roller shaft outside said distributor roller body.

14. The distributor roller of claim 12 wherein said oscillatory cams and said cam followers are carried outside of said distributor roller body.

15. The distributor roller of claim 1 further including heat insulation means secured to said distributor roller body coaxially with said roller shaft.

16. A distributor roller usable in a printing press for distributing fluids and ink by means of rotating and selective axial oscillatory movement; said distributor roller comprising:

a distributor roller body, said distributor roller body carrying a roller gear and being rotatably driven at a first speed by frictional contact with a cooperating roller;

a roller shaft rotatably supported in side frames of the printing press and rotatably driven by said rotating distributor roller body;

a shaft gear secured to said roller shaft;

means for effecting axial oscillatory motion of said distributor roller body with respect to said roller shaft;

a drive housing supported by said roller shaft and rotatably supporting an idler shaft which carries a double pinion having first and second different sized pinion gears with said first pinion gear engaging said roller gear and said second pinion gear engaging said shaft gear; and coupling means to selectively couple said drive housing to the side frame of the pres or to said distributor roller body to cause said distributor roller body to selectively drive said roller shaft at said first speed or at a second different speed at which said oscillatory motion of said distributor roller body with respect to said roller shaft is effected.

17. The distributor roller of claim 16 wherein said coupling means includes an indexing bolt slidably supported in said drive housing for selective axial movement in a first direction against a thrust bearing secured on the side frame.

18. The distributor roller of claim 17 wherein said indexing bolt carries a sliding block, said sliding block having spaced recesses which selectively receive a ball catch to hold said indexing bolt in a selected position.

19. The distributor roller of claim 18 wherein said sliding block has an actuating handle, said actuating handle extending through a slot in said drive housing.

20. The distributor roller of claim 17 wherein said indexing bolt is slidable in a second direction into engagement with a thrust bearing carried on said roller gear.

21. The distributor roller of claim 16 wherein said coupling means includes means for rotatably supporting at least one of said pinion gears on said idler shaft and further includes a means for preventing rotation between said rotatably supported pinion gear and said idler shaft.

22. The distributor roller of claim 16 wherein said coupling means includes multiple wedge sleeve coupling on said idler shaft.

23. The distributor roller of claim 16 wherein said coupling means includes a multiple wedge sleeve coupling on said roller shaft between said distributor roller body and said drive housing.

* * * * *